US006046898A

United States Patent [19]

Seymour et al.

[11] Patent Number: 6,046,898

[45] Date of Patent: Apr. 4, 2000

[54] APPARATUS FOR BLOCKING A D.C. COMPONENT OF A SIGNAL

[75] Inventors: Colin Seymour, South Harrow; Nigel Couch, Brightwell-cum-Sotwell, both of United Kingdom

[73] Assignee: Central Research Laboratories Limited, Middlesex, United Kingdom

[21] Appl. No.: 09/142,470

[22] PCT Filed: Mar. 3, 1997

[86] PCT No.: PCT/GB97/00573

§ 371 Date: Nov. 24, 1998

§ 102(e) Date: Nov. 24, 1998

[87] PCT Pub. No.: WO97/33335

PCT Pub. Date: Sep. 12, 1997

[30] Foreign Application Priority Data

Mar. 6, 1996 [GB] United Kingdom ..... 9604731

[51] Int. Cl.[7] ..... H01P 5/08

[52] U.S. Cl. ..... 361/113; 361/2; 333/246

[58] Field of Search ..... 361/2, 113, 159, 361/777, 792; 333/204, 246, 245; 174/255, 35 R, 261; 307/89, 91, 105

[56] References Cited

U.S. PATENT DOCUMENTS

| | | | |
|---|---|---|---|
| 3,678,414 | 7/1972 | Hallford | 333/7 |
| 3,777,287 | 12/1973 | Louvel . | |
| 3,970,969 | 7/1976 | Sirel et al. . | |
| 4,458,222 | 7/1984 | Herstein et al. | 333/26 |
| 4,542,358 | 9/1985 | Body | 333/246 |
| 5,764,114 | 6/1998 | Kuhne | 333/12 |

FOREIGN PATENT DOCUMENTS

| | | |
|---|---|---|
| 2 571 550 | 4/1986 | France . |
| 59-131208 | 7/1984 | Japan . |

*Primary Examiner*—Jeffrey Gaffin
*Assistant Examiner*—Kim Huynh
*Attorney, Agent, or Firm*—Evenson, McKeown, Edwards & Lenahan, PLLC

[57] ABSTRACT

Apparatus for blocking a d.c. component of a signal, comprises an electrically conductive signal path (1, 2) having a gap (3) in it preventing direct current flow across the gap, and an electrically conductive element (4) spaced from the path by a body (5) of dielectric material, the element (4) being located and dimensioned such that in use an a.c. signal is coupled from the signal path (1) into the element (4) at one side of the gap, and from tie element (4) into the signal path (2) at the other side of the gap. The apparatus optionally includes a quarter wavelength earthing strap between the signal path and ground potential. The apparatus includes means for providing an a.c. signal feed into a hazardous environment in an intrinsically safe manner.

7 Claims, 2 Drawing Sheets

APPARATUS FOR BLOCKING A D.C. COMPONENT OF A SIGNAL

BACKGROUND AND SUMMARY OF THE INVENTION

This invention relates to apparatus for blocking a d.c. component of a signal. The invention relates, particularly, though not exclusively, to apparatus associated with an a.c. signal feed into a hazardous environment, for preventing a spark or arc.

The provision of signals to and from hazardous environments in an intrinsically safe manner is desirable in a number of industries including, for example, the oil and gas industries, the chemicals industry, and environments such as flour mills where dust explosions are possible. In general, equipment for use in such environments must undergo rigorous testing and pass strict criteria to be certified for this type of use.

If a high frequency a.c. signal needs to be fed into such an environment, it is important that d.c. potentials are not transmitted at the same time. This is because such potentials might cause an arc or spark discharge if they are brought close to an electrically conductive object at earth potential. This could result in an explosion in a hazardous flammable environment.

To overcome this problem a number of solutions have been devised. For example, the signal may be fed into the hazardous region as a modulated light beam by way of a fibre-optic light guide. As an alternative, the signal may be radiated into the hazardous environment as an electromagnetic wave from a first (transmitting) antenna to a second (receiving) antenna through a dielectric window.

Such solutions can be expensive to implement and have other associated problems such as, for example, the requirement to convert the required signal to and from excitations in different media resulting in lower efficiency, poorer reliability, and increased power consumption.

It is an object of the present invention to provide an improved apparatus for use in the above mentioned applications.

According to a first aspect of the invention there is provided an apparatus for blocking a d.c. component of a signal, comprising an electrically conductive signal path having a gap in it preventing direct current flow across the gap, and an electrically conductive element spaced from the path by a body of dielectric material, the element being located and dimensioned such that in use an a.c. signal is coupled from the signal path into the element at one side of the gap, and from the element into the signal path at the other side of the gap, characterised in that the apparatus further comprises an electrically conductive earthing path, one end of which is connected to earth, the other end of which is connected to the signal path, the earthing path having a length being an odd multiple of a quarter wavelength of a signal of a given frequency, the earthing path providing a short circuit to earth for signal components having frequencies different from the given frequency or harmonics of the given frequency.

BRIEF DESCRIPTION OF THE DRAWINGS

Embodiments of the invention will now be described, by way of example only, with reference to the accompanying diagrammatic drawings, in which.

DETAILED DESCRIPTION OF THE DRAWINGS

Figure 1:
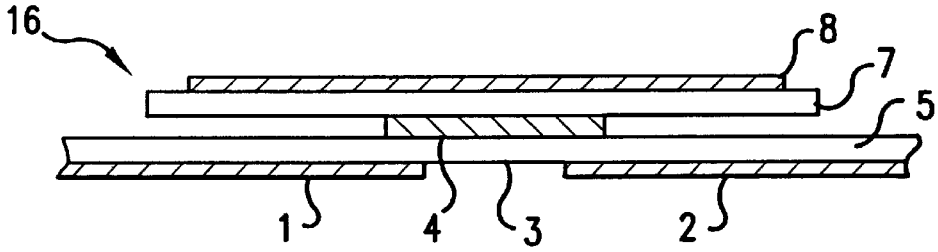
FIG. 1 shows a cross section of a part of a first embodiment.

In FIG. 1, apparatus for blocking a d.c. component of a signal comprises an electrically conductive signal path (1, 2) having a gap (3) in it preventing direct current flow across the gap, and an electrically conductive element (4) spaced from the path by a body of dielectric material (5). The element is located and dimensioned such that in use an a.c. signal is coupled from the signal path (1) into the element (4) at one side of the gap, and from the element (4) into the signal path (2) at the other side of the gap.

In the present example, the signal path (1, 2) comprises a 2 mm wide copper track 35 microns thick printed onto one side of a PTFE substrate (5) 0.8 mm thick. The gap in the signal path between signal path regions 1 and 2 is 12 mm in length. The electrically conductive element (4) comprises a 3 mm wide copper track 35 microns in thickness and 16 mm in length. This electrically conductive element is positioned on the opposite side of the dielectric sheet (5) to that of the signal path, and arranged so that in plan view either end of the element (4) overlaps the parts of the signal path (1, 2) on either side of the gap (3) by approximately 2 mm at each side.

Figure 2:
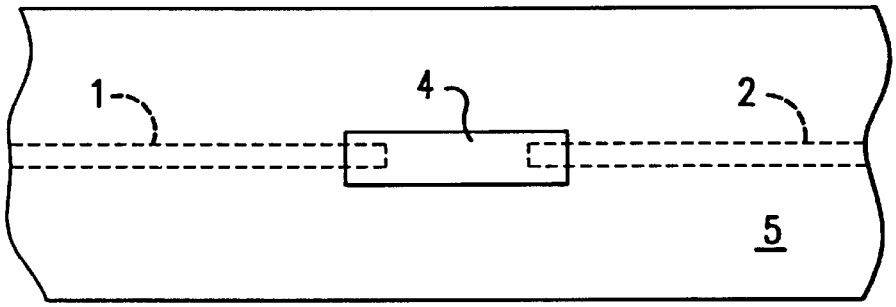
FIG. 2 shows a plan view of the same part as FIG. 1.

In the apparatus shown in FIG. 1 there is a further optional feature present. A further dielectric layer (7) is provided between the electrically conductive element (4) and a further electrically conductive element (8) which constitutes a radio frequency interference shield intended to reduce any radio frequency interference being radiated by the element (4) in use. In order to be effective for this purpose the shield (8) preferably extends over an area significantly larger than that of the element (4). In the present example the element (4) measures 16×3 mm and the shield 8 measures 40×12 mm. The shield is likewise made from 35 micron thick copper carried by a major surface of the dielectric layer (7), the layer being 0.5 mm in thickness. As an alternative to the solid element described, the element may have small perforations therein or be constituted by a mesh. A plan view of the apparatus of FIG. 1 without the optional radio frequency interference shield (7, 8) is shown in FIG. 2.

The gap in the signal track is preferably not less than 10 mm in length. The body of dielectric (5) is preferably no thinner than 0.5 mm. The extent of the overlap required between the signal path and element (4) is determined by the efficiency of coupling between the tracks required in use. The overlap is preferably symmetrical at either side of the gap for optimum efficiency. The d.c. current path in the above example is either along 12 mm of the surface of the dielectric body or through the thickness of the body twice.

Figure 3:
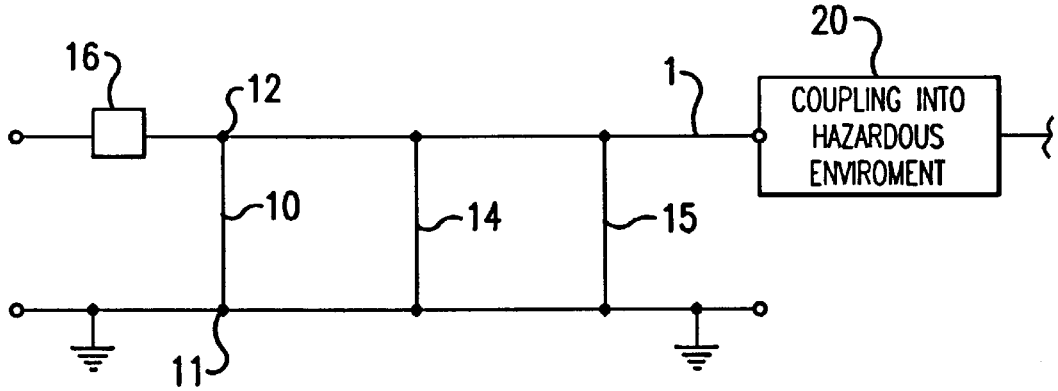
FIG. 3 shows a block diagram of said first embodiment.
Figure 4A:
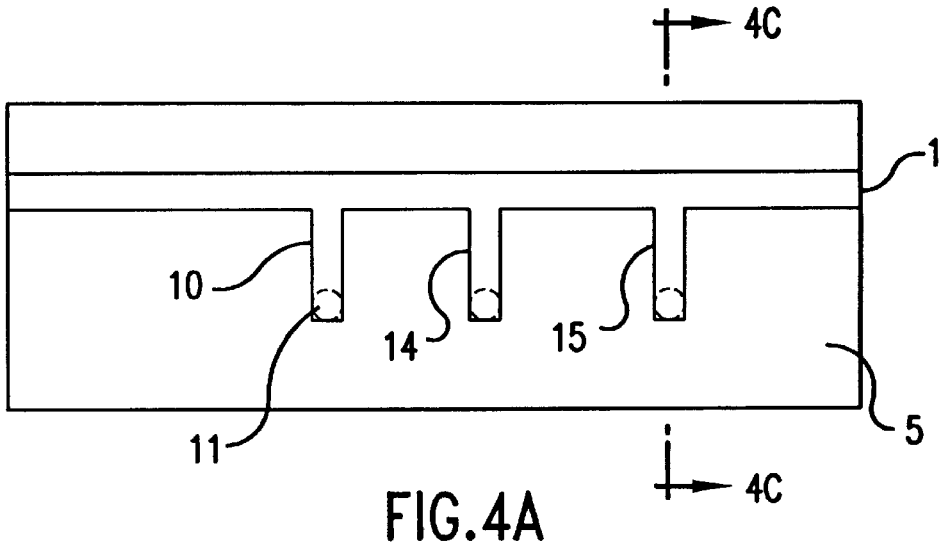
FIG. 4 illustrates the physcial structure of the earthing paths illustrated schematically in FIG. 3.
Figure 4B:
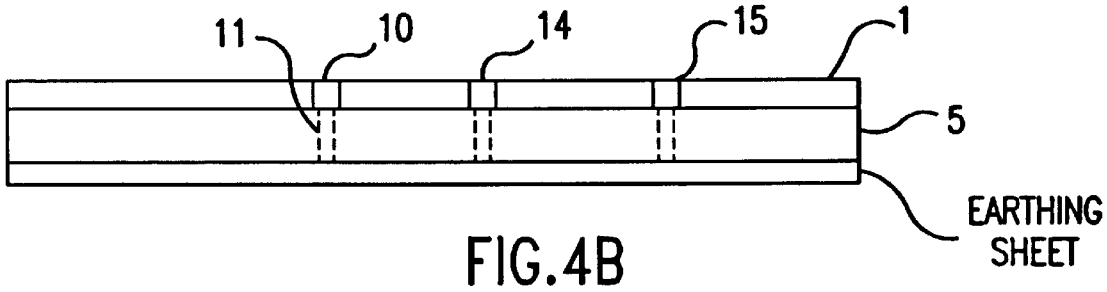
Figure 4C:
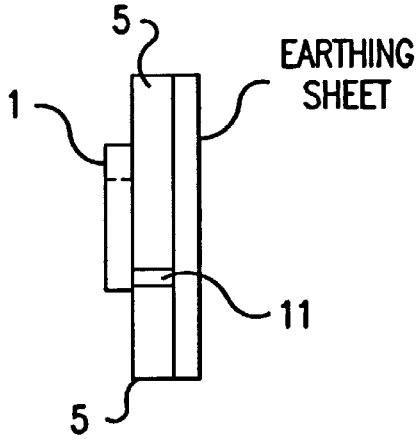

FIG. 3 shows a block diagram of an embodiment according to the invention. In this embodiment the signal path 1 is coupled to apparatus for removing a low frequency component from an a.c. signal, which comprises an electrically conductive earthing path (10), one end (11) of which is connected to earth, the other end (12) of which is connected to the signal path (1), the earthing path (10) having a length being an odd multiple of a quarter wavelength of a signal of a given frequency and providing a short circuit to earth for d.c. or a.c. signal components having frequencies different from the given frequency or harmonics of the given frequency. FIG. 4 illustrates the physcial structure of the signal path and earthing paths shown schmatically in FIG. 3. In the present example the signal path comprises a copper track 2.45 mm wide and the earthing path comprises a 2 mm wide copper track. Both tracks are 35 microns in thickness and are carried by a dielectric substrate (not shown) 0.8 mm thick. In the present example the dielectric sheet is RT/Duroid 5880 board, and there are a plurality of earthing paths coupled to the signal path at various points along its length. FIG. 3 shows three such paths, 10, 14 and 15. In the present example the a.c. signal being carried by the signal path has a frequency of 10 GHz, corresponding to a wavelength of 3 cm in free space. The earthing paths 10, 14 and 15 in the present example are each 5.4 mm in length—corresponding to ¼ wavelength (because of the presence of the dielectric sheet having a different dielectric constant to that of free space). Other odd integer multiples of this length may be substituted if desired for one or more earthing path and will work in the same way.

For maximum safety according to the present invention, the apparatus shown in FIG. 1 is advantageously combined together with the earthing straps described above. This combination is shown in FIG. 3 where the apparatus of FIG. 1 is denoted by the reference numeral 16.

In most practical situations, the apparatus will include a coupling 20 from the signal path into a hazardous environment, the apparatus being adapted to prevent a spark or arc in the hazardous environment. Such couplings, also known as feed-throughs or lead-throughs are well known to persons skilled in the art and are therefore not described in detail here.

Although in the present example a frequency of 10 GHz has been used, other frequencies in the range from 500 MHz to 100 GHz, preferably in the range 1 GHz to 20 GHz may be us(ed as an alternative. Mixed frequency signals may also be used.

Lastly, the priority document for the present application, including in particular the abstract and the diagrams, is incorporated herein by reference.

We claim:

1. Apparatus for blocking a d.c. component of a high frequency signal, comprising an electrically conductive signal path having a gap in it preventing direct current flow across the gap, and an electrically conductive element spaced from the signal path by a body of dielectric material, the element being located and dimensioned such that in use an a.c. signal is coupled from the signal path into the element at one side of the gap, wherein the apparatus further comprises an electrically conductive earthing path, one end of which is connected to earth, the other end of which is connected to the signal path, the earthing path having a length being an odd multiple of a quarter wavelength of a signal of a given frequency, the earthing path providing a short circuit to earth for signal components having frequencies different from the given frequency or harmonics of the given frequency; and further wherein the body is constituted by a dielectric sheet, the signal path and the electrically conductive element being physically supported by respective major surfaces on opposite sides of the dielectric sheet.

2. Apparatus as claimed in claim 1 further comprising an electrically conductive shield positioned adjacent the element which reduces radio frequency interference radiating from the apparatus in use.

3. Apparatus as claimed in claim 2 in which the earthing path and signal path are supported by a common substrate, and the given frequency is greater than 500 MHz.

4. Apparatus as claimed in claim 3 including means for providing an a.c. signal feed into a hazardous environment, the apparatus being adapted to prevent a spark or arc in the hazardous environment.

5. Apparatus as claimed in claim 2 including means for providing an a.c. signal feed into a hazardous environment, the apparatus being adapted to prevent a spark or arc in the hazardous environment.

6. Apparatus as claimed in claim 1 in which the earthing path and signal path are supported by a common substrate, and the given frequency is greater than 500 MHz.

7. Apparatus as claimed in claim 1 including means for providing an a.c. signal feed into a hazardous environment, the apparatus being adapted to prevent a spark or are in the hazardous environment.

* * * * *